US012274401B2

(12) United States Patent
Burris

(10) Patent No.: US 12,274,401 B2
(45) Date of Patent: Apr. 15, 2025

(54) DECORATIVE TOILET LID

(71) Applicant: Andrew D. Burris, Beaufort, SC (US)

(72) Inventor: Andrew D. Burris, Beaufort, SC (US)

( * ) Notice: Subject to any disclaimer, the term of this patent is extended or adjusted under 35 U.S.C. 154(b) by 129 days.

(21) Appl. No.: 18/121,263

(22) Filed: Mar. 14, 2023

(65) Prior Publication Data

US 2024/0306865 A1 Sep. 19, 2024

(51) Int. Cl.
*A47K 13/24* (2006.01)

(52) U.S. Cl.
CPC ..... *A47K 13/24* (2013.01)

(58) Field of Classification Search
CPC ..... A47K 13/24
USPC ..... 4/234, 237, 242.1, 902
See application file for complete search history.

(56) References Cited

U.S. PATENT DOCUMENTS

| | | | | |
|---|---|---|---|---|
| D252,946 | S * | 9/1979 | Johnson | D23/312 |
| 4,407,024 | A | 10/1983 | Schneider | |
| D292,019 | S * | 9/1987 | Hall | 4/242.1 |
| 5,829,073 | A | 11/1998 | Lee | |
| 6,038,711 | A | 3/2000 | Clarke | |
| D447,794 | S | 9/2001 | Hulsebus et al. | |
| 9,398,835 | B2 * | 7/2016 | McCarthy | A47K 13/24 |
| 9,636,896 | B2 * | 5/2017 | Wu | B32B 7/12 |
| 9,648,998 | B2 | 5/2017 | Wu | |
| 10,049,597 | B2 * | 8/2018 | McCarthy | A47K 17/00 |
| 2002/0112280 | A1 | 8/2002 | Christmas | |
| 2005/0055756 | A1 | 3/2005 | Curtis | |
| 2006/0130230 | A1 * | 6/2006 | Lalicata | A47K 17/00 4/661 |
| 2008/0072371 | A1 | 3/2008 | Rogers | |
| 2008/0178373 | A1 | 7/2008 | Selle | |
| 2010/0218306 | A1 | 9/2010 | Krazinsky | |
| 2012/0266371 | A1 * | 10/2012 | Zhang | A47K 13/24 156/60 |
| 2014/0162226 | A1 | 6/2014 | Longenecker | |

* cited by examiner

*Primary Examiner* — Huyen D Le
(74) *Attorney, Agent, or Firm* — P. Jeff Martin; The Law Firm of P. Jeffrey Martin, LLC

(57) ABSTRACT

A toilet lid apparatus includes an ovoid body defined by an outer surface and an inner surface, a thickness of the body defining the spaced relationship of the outer surface and the inner surface, an image formed on at least one surface of the body, and means for coupling the body of the image with the lid.

11 Claims, 6 Drawing Sheets

DECORATIVE TOILET LID

I. RELATED APPLICATIONS

There are no previously filed, nor currently any co-pending applications, anywhere in the world.

II. FIELD OF THE INVENTION

This application discloses claims and embodiments generally related to a decorative toilet lid.

III. BACKGROUND OF THE INVENTION

Numerous attempts have been made to improve toilet lid and seat configurations or arrangements. For example, the following inventions relate to such improved devices:

U.S. Pat. No. 4,407,024, issued in the name of Schneider;
U.S. Pat. No. 6,038,711, issued in the name of Clarke;
U.S. Patent Application No. 2014/016226 A1, published in the name of Longenecker;
U.S. Pat. No. D447,794 S, issued in the name of Hulsebus et al.;
U.S. Pat. No. 5,829,073, issued in the name of Lee;
U.S. Patent Application No. 2008/0072371 A1, published in the name of Rogers;
U.S. Pat. No. 9,648,998 B2, issued in the name of Wu;
U.S. Patent Application No. 2002/0112280 A1, published in the name of Christmas;
U.S. Patent Application No. 2005/0055756 A1, published in the name of Curtis;
U.S. Patent Application No. 2008/0178373 A1, published in the name of Selle; and
U.S. Patent Application No. 2010/0218306 A1, published in the name of Krazinsky.

Accordingly, there is a continued need for improvement in toilet seat and/or lid devices.

IV. SUMMARY OF THE INVENTION

In one embodiment, a toilet lid apparatus comprises an ovoid body defined by an outer surface and an inner surface, a thickness of the body defining the spaced relationship of the outer surface and the inner surface, an image disposed on at least one surface of the body, and means for coupling the body with a toilet seat.

In another embodiment, a toilet seat and cover apparatus comprises a seat, a cover comprising an ovoid body defined by an outer surface and an inner surface, a thickness of the body defining the spaced relationship of the outer surface and the inner surface, an image disposed on at least one surface of the body, and means for coupling the body with a toilet seat.

In another embodiment, a toilet comprises a tank in fluid communication with a bowl, the bowl including a bowl-shaped body having a peripheral upper rim and a tapered lower channel outlet adapted for fluid communication with an outlet drainage conduit. The toilet also includes a seat and cover apparatus, wherein the seat and cover are mutually coupled together, and wherein the seat and cover apparatus is coupled to the bowl-shaped body and supported on the peripheral upper rim of the bowl, the seat and cover apparatus coupled to permit selective articulation of the seat, the cover, and the combination of the seat and cover through approximately 90 degrees between a lowered position and a raised position, the seat adapted for direct contact with the peripheral upper rim of the bowl, and the cover comprising an ovoid body defined by an outer surface and an inner surface, a thickness of the body defining the spaced relationship of the outer surface and the inner surface, the cover. The toilet also includes an image disposed on at least one surface of the body.

In each of the embodiments, each image includes any representation, depiction, graphic, symbol, design, color, letter, numeral, photograph, drawing, illustration, painting, and licensed characters. Each image may comprise a two-dimensional, or a three-dimensional image, or a combination of two-dimensional and three-dimensional images.

In each embodiment, the image may be disposed on the inner surface, or on the outer surface, or a combination of the inner surface and the outer surface.

For each embodiment, the image or images may be disposed on a cover that is adapted for attachment to the ovoid body of the lid.

V. BRIEF DESCRIPTION OF THE DRAWING(S)

The advantages and features of the present invention will become better understood with reference to the following more detailed description and claims taken in conjunction with the accompanying drawings, in which like elements are identified with like symbols, and in which:

Figure 2:
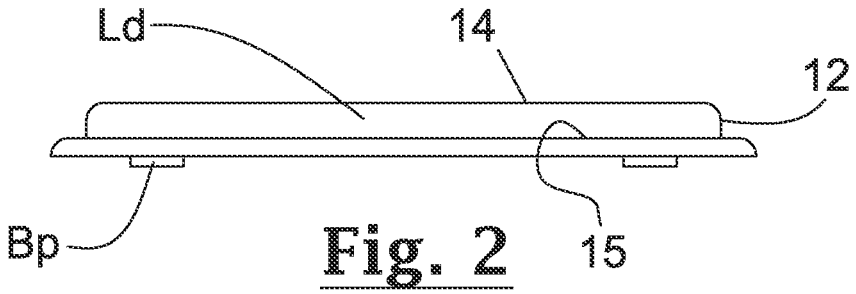
FIG. 2 is a front view of a lid and seat combination apparatus.
Figure 3:
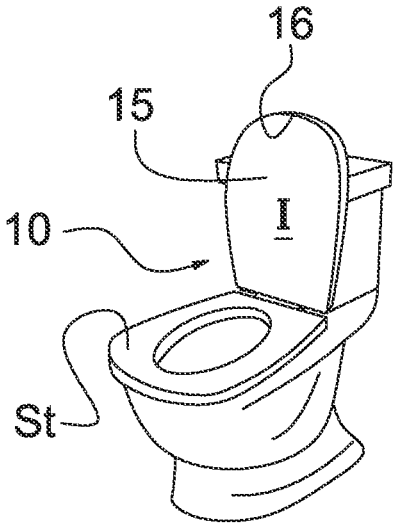
Figure 4:
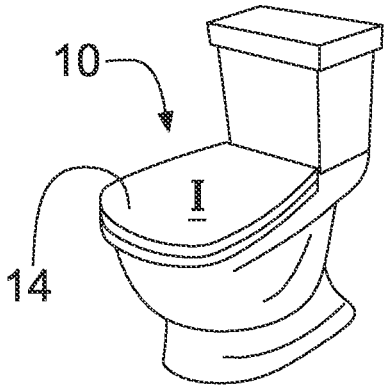
Figure 5:
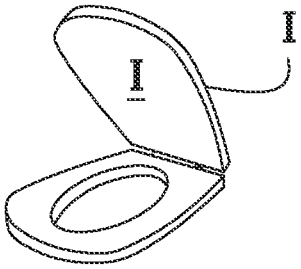
Figure 2A:
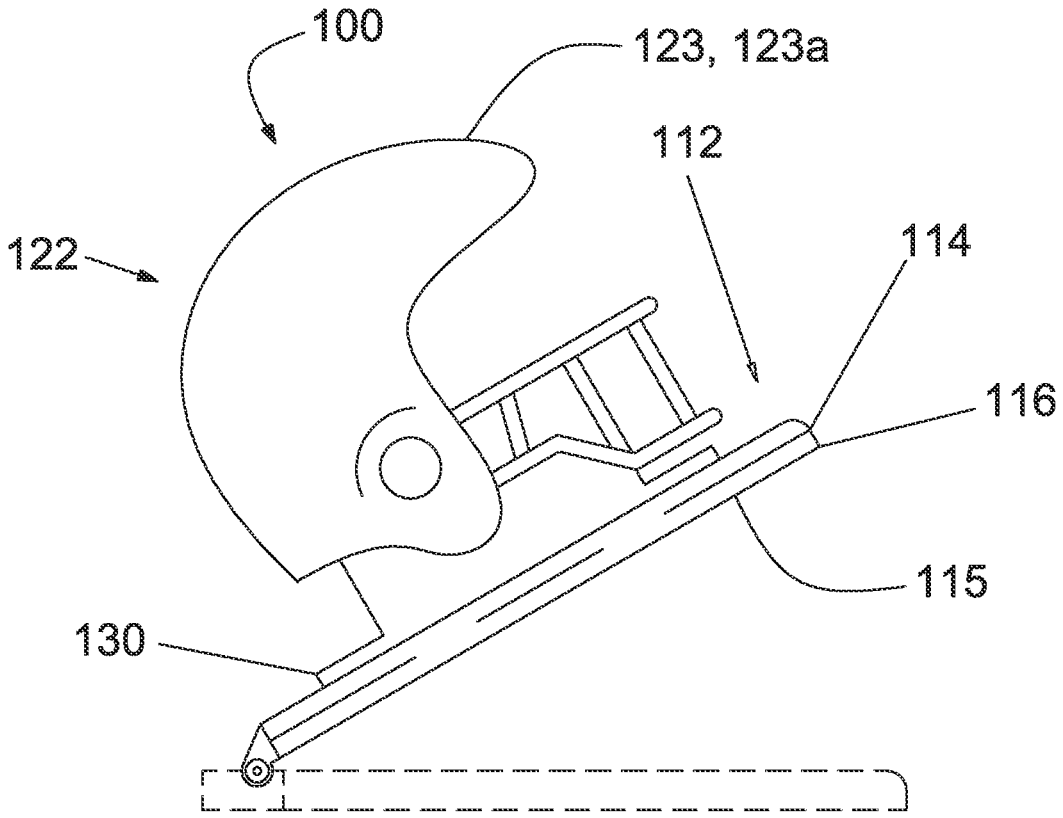
Figure 6:
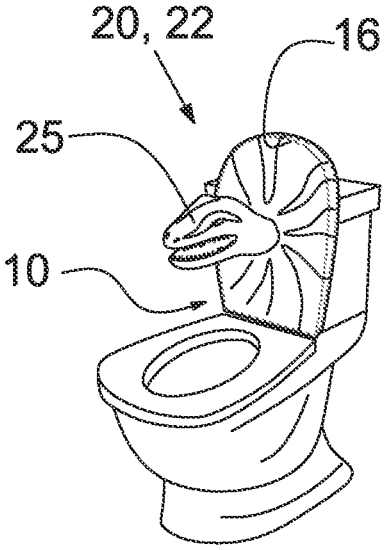
Figure 7:
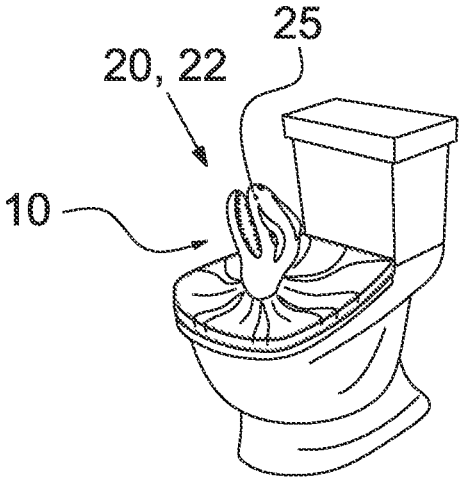
Figure 8A:
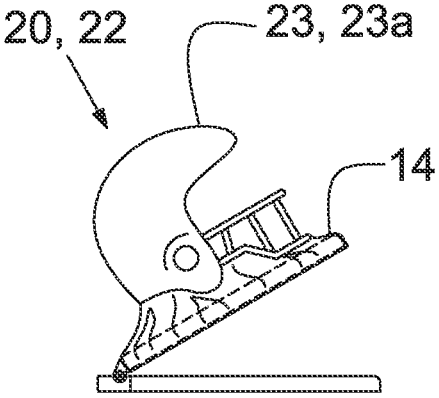
Figure 8B:
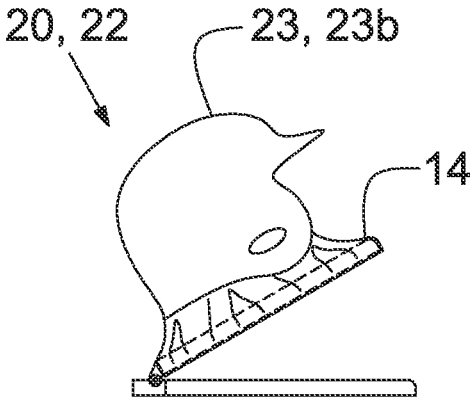
Figure 7A:
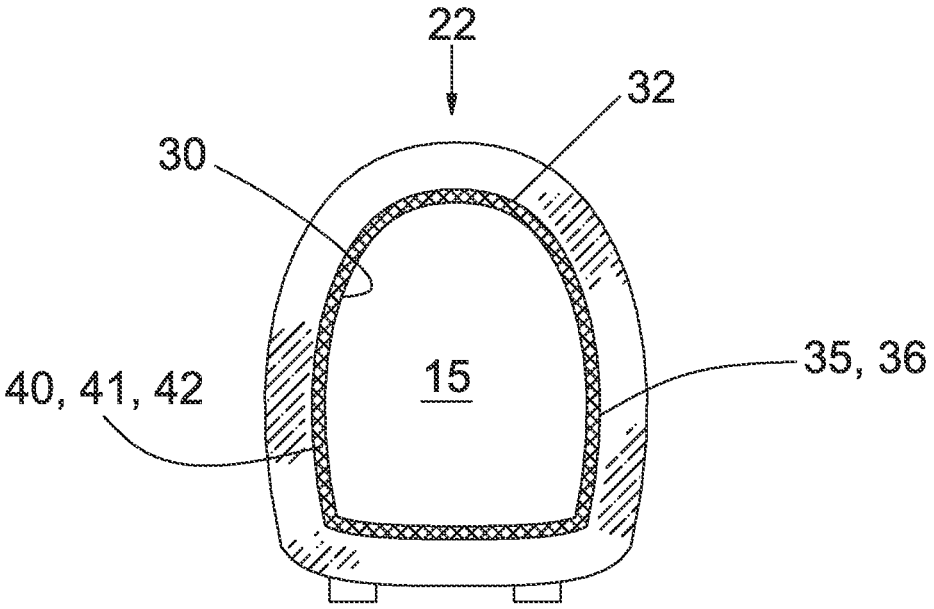
Figure 8C:
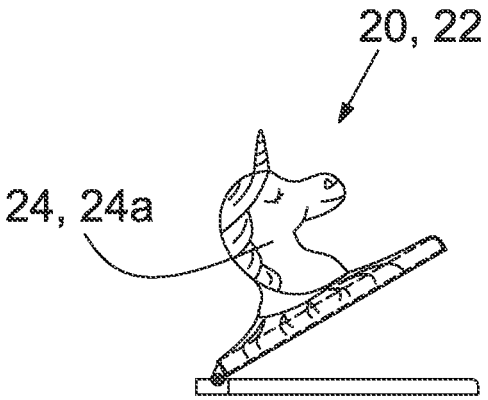
Figure 8D:
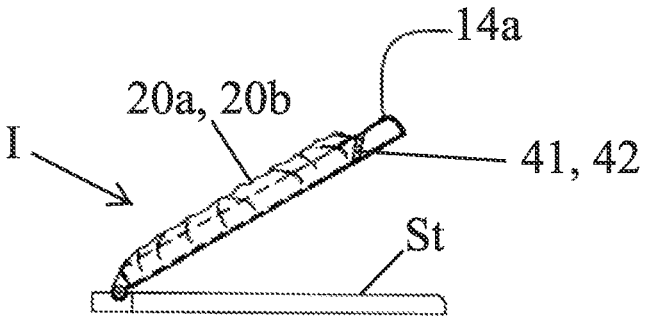

FIG. 2*a* is a side elevational view of a lid apparatus, in accordance to an alternate embodiment of the present invention;

FIG. 3 is a perspective view of a lid in a raised or opened-position with an image applied or secured to the inner surface of the lid and visible to observers when lid is so positioned;

FIG. 4 is a perspective view of a lid in a lowered or closed-position with an image applied or secured to the outer surface of the lid and non-visible to observers when lid is so positioned;

FIG. 5 is a perspective view of a lid in a half-position (between lowered and raised) with an image applied or secured to the inner surface of the lid and the outer surface of the lid;

FIG. 6 is a perspective view of a lid in a raised or opened-position with an image of a dinosaur head applied or secured to the inner surface of the lid and visible to observers when lid is so positioned;

FIG. 7 is a perspective view of a lid in a lowered or closed-position with an image of a dinosaur head applied or secured to the outer surface of the lid and non-visible to observers when lid is so positioned;

FIG. 7*a* is a bottom plan view of a toilet lid illustrating the attachment of a decorative article to the lid, in accordance to one embodiment of the present invention;

FIGS. 8*a*-8*c* are side elevational views of a lid in a half-position (between lowered and raised) each depicting a three-dimensional decorative image applied or secured to the outer surface of the lid; and FIG. 8*d* is a side elevational view depicting another embodiment of the present invention.

VI. DETAILED DESCRIPTION OF THE EMBODIMENT(S)

It will be readily understood that the components of the present invention, as generally described and illustrated in the figures herein, may be arranged and designed in a wide variety of different configurations. Thus, the following detailed description of the embodiments, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present invention. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

Figure 1:
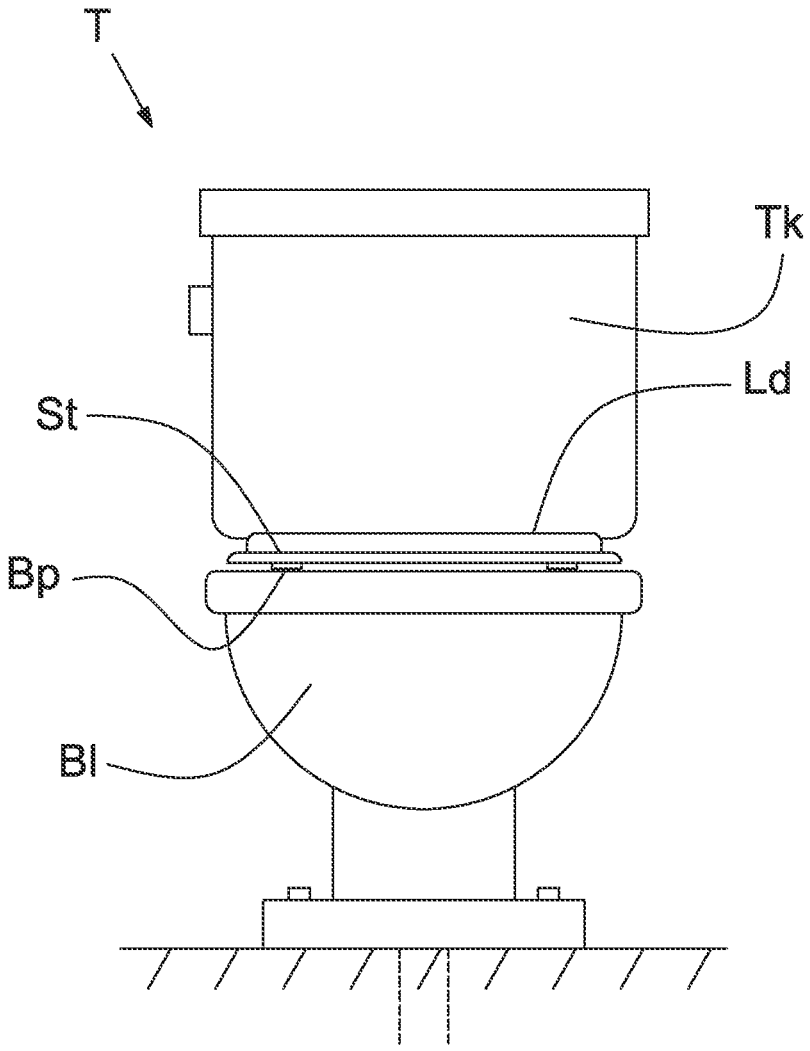
Fig. 1 Prior Art
FIG. 1 is an illustration of a standard bathroom toilet apparatus and configuration, depicting a tank for supplying water to the bowl and a seat and lid affixed to the bowl.

FIG. 1 depicts a standard or conventional bathroom toilet apparatus (T), wherein the toilet (T) comprises a tank (Tk) functioning as a water reservoir supplying fresh water to the bowl (Bl) when flushed, and with the bowl (Bl) having a seat (St) and lid (Ld) affixed thereto. Typically, the seat (St) comprises a toroidal (or a closed-front) or a horseshoe (or open-front) configuration and having a plurality of bumpers (Bp) affixed on the underside of the seat (St) to provide support and prevent sliding or unnecessary movement of the seat (St) across the opening of the bowl (Bl). Typically, the lid (Ld) comprises the same general shape or form of the seat (St) (an ovoid form with a closed-end) with a hinge or other means for articulating the lid (Ld) between an open and closed orientation relative to the seat (St). In a closed orientation, the lid (Ld) covers the seat (St) and the inner volume within the bowl (Bl). In an open orientation, the lid (Ld) exposes the seat (St) and the inner volume of the within the bowl (Bl), thereby allowing an occupant to utilize the apparatus as intended.

Referring now to FIG. 2 through FIG. 7, an improved toilet lid 10 apparatus is described and depicted herewith, the lid 10 apparatus comprising a body 12 defined by an outer surface 14 and an inner surface 15, the outer surface 14 and inner surface 15 integrally joined at an interface 16. In one embodiment, the lid 10 apparatus comprises an image(s) or indicium/indicia (I) disposed on at least one surface 14 or 15. In another embodiment, the image or indicia (I) may be integral to the surface 14 or 15. In another embodiment, the image or indicia (I) may be a separate decorative article 20 applied or detachably secured to the surface 14 or 15, such as a film-sheet, a cover, or a fabric. For these embodiments, (I) may comprise two-dimensional, three-dimensional, and/or a combination of two- and three-dimensional image(s) and/or indicium/indicia. The image(s)/indicium/indicia (I) may comprise a variety of depictions, representations, graphics, symbols, designs, colors, letters, numerals, photographs, drawings, illustrations, paintings, and/or licensed characters, licensed articles, and the like. (I) is provided for decoration enhancement, including themed home or travel accommodations (e.g., themed-resort décor). (I) may also be provided as means for promoting toilet training and/or usage for children of various ages and/or abilities.

For a two-dimensional depiction, (I) may comprise a printed or screen-produced film-sheet with temporary adhesive or other suitable means for applying and/or securing (I) to the lid (Ld) surface(s) 14 and/or 15. Similarly, (I) may comprise a printed or screen-produced cover or fabric (or other similar material) that includes a pocket or other area for receiving a portion of the lid (Ld) and with means for temporarily securing the cover or fabric to the lid (Ld). For a three-dimensional decorative depiction, the (I) may comprise a formed, layered, printed, or otherwise assembled image or indicium/indicia that includes contour(ing) for providing visual depth and quality. In accordance to one embodiment, the image (I) may comprise a three-dimensional decorative article 22 constructed of a collapsible, returnably-resilient, and/or memory-foam type material, or a material otherwise suitable to allow the indicia/image (I) to collapse and expand without damage or distortion to the image (I), and thereby allowing the lid (Ld) to be fully opened with the image (I) temporarily compressing as it engages the front of the toilet apparatus tank (Tk), and temporarily maintaining a compressed configuration as the lid (Ld) remains positioned temporarily in a generally vertical position, thereby allowing the user to use the toilet (T) in a conventional manner. Thereafter, the image (I) returns to its original shape once the lid (Ld) is closed as the compressed material is released from its compressed state. It is envisioned that the compressible and returnably resilient material may be formed from one of or in combination with elastic foam, viscoelastic (memory) foam, and the like. The three-dimensional decorative article 22 may comprise a dinosaur head 25, a sports-related decorative article 23, such as including, but not limited to, a football helmet 23*a* and a baseball helmet 23*b*, and a fanciful decorative article 24, such as a unicorn, and more particularly, a unicorn head 24*a*.

For example, in one embodiment, consistent with FIG. 6, (I) is depicted as a head of a dinosaur 25 (e.g., a tyrannosaurus rex) applied or secured to the inner surface 15 of the lid (Ld). In another example consistent with FIG. 7, and in accordance to a preferred embodiment, (I) is depicted as a dinosaur head 25 (e.g., a tyrannosaurus rex as depicted) applied or detachably secured to the outer surface 14 of the lid (Ld). In another preferred exemplary embodiment, consistent with FIGS. 8*a*, 8*b*, and 8*c*, (I) is applied or secured to the outer surface 14 of the lid (Ld), wherein the image (I) comprises a compressible and/or returnably resilient material in the form of a licensed article, such as protective head gear from a sport such as football and baseball. In a related example, the helmet may be applied or secured to either the outer surface 14 or the inner surface 15 and a different portion of the anatomy (e.g., tail; front talons; real talons) may be applied or secured to the opposing surface 14 or 15.

(I) may be printed or applied directly to the surface(s) 14 and/or 15 through various printing processes, or may be applied via a film-sheet (e.g., two-dimensional print) placed or secured thereon, or may be applied or secured as a fabricated appliance (e.g., three-dimensional fabrication or printing). Moreover, it is further envisioned that a combination or sub-combination of the method(s) and/or process(es) described above may be utilized to achieve such application and/or securement of (I) to the surface(s) 14 and/or 15.

In one embodiment, consistent with FIG. 3, image or indicia (I) is disposed on the inner surface 11 of lid (Ld). In providing the image-indicium/indicia (I) on the inner surface 11, a visual enticement or curiosity may be provided especially in children for developing toilet training routines and encouragement thereof. Disposing (I) on the inner surface 11 allows a parent, guardian, or overseer (e.g., day-care manager; school-teacher) to control the visual display, wherein positioning the lid (Ld) in an open-position might strike the visual curiosity of a child or children through direct line-of-sight, and wherein positioning the lid (Ld) in a closed-position might strike the visual curiosity of a child or children through recollection or verbal instruction from an adult or other children, utilizing positive peer pressure or encouragement within peer groups.

For example, in a lid (Ld) in open-position (with (I) observable), an adult may encourage a child to utilize the toilet apparatus (T) by pointing out the appealing visual image-indicium/indicia (I) and suggesting that the child can visit the toilet and enjoy the image while utilizing the apparatus. Alternatively, in a lid (Ld) in a closed-position (with (I) not-yet observable), an adult may encourage a child to utilize the toilet apparatus (T) to get the surprise appealing visual image-indicium/indicia (I).

In another embodiment, consistent with FIG. 4, image or indicia (I) is disposed on the outer surface 14 of lid (Ld). In providing the image-indicium/indicia (I) on the outer surface 14, visual enticement or curiosity may be provided and a different encouragement in closing the lid (Ld) once the toilet apparatus (T) is utilized. Moreover, there is at least some suggestion that a closed lid (Ld) provides improved sanitary conditions within a bathroom facility.

For example, in a closed-position (with (I) not-yet observable), similar suggestions noted above may be utilized with a child to visit the toilet apparatus (T) to get the surprise appeal of the visual image-indicium/indicia. Likewise, in an opened-position (with (I) observable), a similar suggestion as noted above may be utilized.

In another embodiment, consistent with FIG. 5, (I) may be disposed on both surfaces 14 and 15, including the same image on both, related images (e.g., head and tail), or complementary images (e.g., basketball and hoop). In such a configuration, similar training methodologies and/or suggestions may be employed with encouraging children to visit the toilet apparatus (T) and get the appealing visual reward that may be used in toilet training and the like.

As depicted in FIG. 5, the lid 10 apparatus may be coupled to a seat (St) via means, such as one of many hinges (Hg) utilized for such couplings and connections. It is envisioned that the lid 10 apparatus is a separate apparatus, integrated with a seat (St) as a combined apparatus (such as depicted in FIG. 2), a separate decorative apparatus being modular in design (as illustrated in FIG. 2*a*), thus being attachable to an existing or conventional toilet seat (St), and/or a combined device as a lid (Ld), seat (St), and bowl (Bl) with tank (Tk) to form a toilet (as depicted in FIGS. 3-5).

In reference to FIG. 2*a*, in accordance to one embodiment, the lid 100 apparatus is modular in design, being configured for attachment to an existing toilet seat (St) as an aftermarket product. It is envisioned the lid 100 apparatus may also be manufactured in combination with a toilet seat (St), or manufactured in combination with a standard or conventional bathroom toilet apparatus (T).

The lid 100 apparatus comprises a body 112 defined by an outer surface 114 and an inner surface 115, the outer surface 114 and inner surface 115 integrally joined at an interface 116. The lid 100 apparatus further comprises a three-dimensional decorative article 122 securely affixed superjacent the outer surface 114 of the lid 100 apparatus. The three-dimensional decorative article 122 may be securely affixed to the outer surface 114 of the lid 100 apparatus via a mounting bracket or mounting platform 130. The three-dimensional decorative article 122 is constructed of a collapsible, returnably-resilient, and/or memory-foam type material, or a material otherwise suitable to allow the decorative article 122 to collapse and expand without damage or distortion to the decorative article 122, and thereby allowing the lid 100 to be fully opened with the decorative article 122 temporarily compressing as it engages the front of the toilet apparatus tank (Tk), and thereafter the decorative article 122 returns to its original shape once the lid 100 is closed as the compressed material is released from its compressed state.

The three-dimensional decorative article 122 may comprise a sports-related decorative article 123, such as including, but not limited to, a football helmet 123*a* (as depicted in FIG. 2*a*), and a baseball helmet. The three-dimensional decorative article 122 may further comprise a dinosaur head, and a fanciful decorative article, such as a unicorn, and more particularly, a unicorn head. The three-dimensional decorative article 122 may also function as a handle by which the user may grasp to raise and lower the lid 100 apparatus. For example, in the embodiment depicted in FIG. 2*a*, the face-mask of the helmet 123*a* provides a handle by which the user may grasp to easily raise and lower the lid 100 apparatus.

The lid 100 apparatus may be attached to a conventional or standard toilet seat (St) via attachment means or hardware well known in the art, such as toilet bolts, caps, washers, flanges, toilet seat hinge assemblies, and standard or universal hinge coupling mechanisms utilizing standard bolt fasteners that traverse through a hinge base of the toilet seat (St), and into the smooth porcelain holes of the toilet bowl (Bl), and quick-release locking systems utilizing locking caps.

As depicted in FIGS. 8*a*-8*c*, a decorative article 20 is depicted and is removably coupled and/or detachable from the lid (Ld) of a toilet apparatus (T). It is envisioned that the decorative article 20 may be detachably coupled to the lid (Ld) via a variety of means 40, including elastic band(s) 42, stretchable and/or returnably resilient fabric(s), drawstring(s), zipper(s), clasp(s), snap-button(s), button-and-hole enclosure(s), adhesive seal(s), and the like. Consistent with previous embodiments, the decorative article 20 may comprise image(s) and/or indicium/indicia as part of a 2-D format, a 3-D format, and/or a combination thereof. In particular, FIGS. 8*a* and 8*b* depict a sports-related decorative article 23, wherein the article 23 comprises the representation of protective head gear from either football or baseball, and more particularly may be licensed protective head gear from professional and/or collegiate sources. It is envisioned that the decorative article 20, 22 is easily coupled and removed so as to encourage the interchanging of protective head gear according to the sports season underway. In the U.S., with professional football and professional baseball competitive seasons almost completely encompassing the entire 52-week calendar year, it is envisioned that a household might purchase a football helmet with the appropriately licensed logo of a preferred football team and a separate baseball helmet with a similarly appropriate licensed logo of a preferred baseball team, wherein the football helmet is secured to the lid until the conclusion of the professional football season and replaced by the baseball helmet until the conclusion of baseball season, as but one non-exhaustive example.

To facilitate quick, easy, and efficient detachable securement of the decorative article 20, 22 to a toilet lid (Ld), the decorative article 20, 22 comprises a peripheral edge 30 forming a loop 32, the loop 32 securely enclosing an elastic member 41, such as an elastic band 42, via a suitable attachment means 35, such as including, but not limited to, stitching 36 and thermal bonding. The peripheral edge 30 of the decorative article 20, 22 is stretched and placed over the outer surface 14 of the lid (Ld) and extended over the interface 16. The elastic band 42 contracts, thus securely holding the decorative article 20, 22 in place on the toilet lid (Ld), as shown in FIGS. 7 and FIGS. 8*a*-8*c*.

As previously described, the decorative article 20 is preferably detachably coupled to the outer surface of the lid (Ld) of the toilet apparatus (T). However, it is envisioned that the article 20 may also be permanently affixed to the outer surface of the lid (Ld) of the toilet (T), thus such means of secured attachment by the article 20 to the lid (Ld) is within the spirit and scope of the present application.

In reference to FIG. 8*d*, in accordance to yet another embodiment, the image or indicia (I) may be a separate functional article 20*a* detachably secured to the surface 14*a* of the lid (Ld) of a standard or conventional bathroom toilet apparatus (T). The functional article 20*a* depicted in FIG. 8*d* is a shower cap 20*b*. The functional article 20*b* is detachably secured to the toilet lid (Ld) via an elastic member 41, such as an elastic band 42, in a manner being identical to the method of attachment described hereinabove in paragraph in reference to the embodiments depicted in FIGS. 8*a*-8*c*. Therefore, for purposes of brevity and obviating redundancy, the method of detachably securing the functional article 20*a* to a toilet lid (Ld), along with elements associated therewith, shall not be further described.

It is to be understood that the embodiments and claims are not limited in its application to the details of construction and arrangement of the components set forth in the description and illustrated in the drawings. Rather, the description and the drawings provide examples of the embodiments envisioned, but the claims are limited to the specific embodiments. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the U.S. Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

What is claimed is:

1. A toilet lid apparatus comprising:

a body defined by a three-dimensional representation and means for coupling the body with a toilet seat, wherein the body comprises an ovoid body, the ovoid body comprising an outer surface and an inner surface, a thickness of the body defining the spaced relationship of the outer surface and the inner surface, and an image disposed on at least one surface of the body, the image is disposed on the inner surface and the outer surface of the ovoid body, and wherein the image comprises a first image disposed on the inner surface and a second image disposed on the outer surface of the ovoid body, wherein the first image comprises the head of the animal and the second image comprises a tail of the animal.

2. The apparatus of claim 1, wherein the image is disposed on a cover adapted for attachment to the ovoid body.

3. A decorative article for a lid of a toilet apparatus, the lid of the toilet apparatus having an outer surface and an inner surface, wherein the decorative article comprises:

an image forming at least one surface of the lid, the image comprising a three-dimensional representation of an object, wherein the three-dimensional representation comprises a returnably resilient material; and means for coupling the three-dimensional representation to the lid, wherein the means for coupling of the three-dimensional representation to the lid provides visual orientation of the image along the at least one surface of the lid, wherein the three-dimensional representation comprises a three-dimensional decorative article, wherein the three-dimensional decorative article comprises at least one of a dinosaur head, a fanciful decorative article, and a sports-related decorative article comprising a football helmet and a baseball helmet.

4. The apparatus of claim 3, wherein the image further comprises at least one of a representation, depiction, graphic, symbol, design, color, letter, numeral, photograph, drawing, illustration, painting, licensed characters, and licensed trademarks.

5. The apparatus of claim 3, wherein the fanciful decorative article comprises a unicorn head.

6. The apparatus of claim 3, wherein the three-dimensional decorative article is disposed on the outer surface of the lid.

7. The apparatus of claim 3, wherein the means for coupling is selected from at least one of elastic band(s), returnably resilient fabric(s), drawstring(s), zipper(s), clasp(s), snap-button(s), button-and-hole enclosure(s), and adhesive seal(s).

8. A toilet seat and cover apparatus comprising:

a seat;

a cover comprising a body, wherein the body comprises an ovoid body and an image, the ovoid body comprising an outer surface and an inner surface, a thickness of the body defining the spaced relationship of the outer surface and the inner surface, the image comprising a three-dimensional representation, wherein the image comprises a first image disposed on the inner surface and a second image disposed on the outer surface of the ovoid body, wherein the first image comprises the head of the animal and the second image comprises a tail of the animal; and means for coupling the body with a toilet seat.

9. The apparatus of claim 8, wherein the image is disposed on the inner surface of the ovoid body.

10. The apparatus of claim 8, wherein the image is disposed on the outer surface of the ovoid body.

11. The apparatus of claim 8, wherein the image is disposed on a cover adapted for attachment to the ovoid body.

* * * * *